US006276546B1

(12) United States Patent
Davis et al.

(10) Patent No.: US 6,276,546 B1
(45) Date of Patent: Aug. 21, 2001

(54) PLASTIC CONTAINER FOR CARBONATED BEVERAGES

(75) Inventors: Craig P. Davis, Atlanta; Daniel M. Futral; John P. Henderson, both of Kennesaw; Stephen R. Lynn, Douglasville, all of GA (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 09/331,545

(22) PCT Filed: Dec. 17, 1997

(86) PCT No.: PCT/US97/23442

§ 371 Date: Aug. 2, 1999

§ 102(e) Date: Aug. 2, 1999

(87) PCT Pub. No.: WO98/28193

PCT Pub. Date: Jul. 2, 1998

Related U.S. Application Data

(63) Continuation-in-part of application No. 08/771,169, filed on Dec. 20, 1996, now abandoned.

(51) Int. Cl.[7] ..... B65D 1/42; B65D 23/00

(52) U.S. Cl. ..... 215/375; 215/373; 220/606; 220/608

(58) Field of Search ..... 215/373, 375; 220/606, 608

(56) References Cited

U.S. PATENT DOCUMENTS 5,603,423 * 2/1997 Lynn et al. ..... 215/375

* cited by examiner

*Primary Examiner*—Sue A. Weaver
(74) *Attorney, Agent, or Firm*—Brinks Hofer Gilson & Lione

(57) ABSTRACT

A plastic container comprises a lower base forming portion that includes a plurality of circumferentially spaced downwardly convex segments (126) and a plurality of intervening, circumferentially spaced, totally convex, hollow foot forming portions (121) that extend radially from the central bottom portion (120) and downwardly from the downwardly convex segments to form a clearance (124) for the central bottom portion. The downwardly convex segments have smoothly curved cross sections, in radially extending planes through their central regions and coplanar with the container's longitudinal axis (120*a*). The clearance forming portion (123) of each foot forming portion includes a compound curved offset formed with opposing radii of curvature lying in a range of about 15% to over about 30% of foot contact diameter, the compound curved offset curving downwardly and outwardly about a center of curvature (131) below the bottom forming portion before curving about a center of curvature (130) above the bottom forming portion.

27 Claims, 13 Drawing Sheets

PLASTIC CONTAINER FOR CARBONATED BEVERAGES

This application is a 371 of PCT/US97/23442 filed Dec. 17, 1997 and a CIP of Ser. No. 08/771,169 filed Dec. 20, 1996, now abandoned.

FIELD OF THE INVENTION

This invention relates to plastic containers for fluids under pressure, such as carbonated soft drinks, beer and the like. More particularly, this invention relates to bottoms for plastic bottles for carbonated beverages that can provide a stable container of minimal height and resistance to distention, crazing and stress cracking.

BACKGROUND OF THE INVENTION

Plastic containers that can reliably contain carbonated beverages generating internal pressures as high as 100 psi or more and that can be inexpensively manufactured in attractive shapes pose a technical problem that has received substantial attention by those working in this art.

The spherical shape, which has the greatest ratio of volume to surface area, provides an optimum uniform distribution of wall stresses generated by internal pressures and thus achieves the maximum reliable and effective strength for a given wall material thickness, and, indeed, internal pressures within non-spherically-shaped containers tend to urge the non-spherically-shaped containers toward a spherical shape. A spherical shape is, however, unacceptable as a commercial beverage container because, among other obvious reasons, a sphere has no stable base, is difficult to handle, and cannot effectively use shelf and storage space of retail and wholesale purveyors and manufacturers.

Workers in the art have sought to develop cylindrical plastic beverage containers that can reliably and attractively contain carbonated beverage products, can be easily handled, can be inexpensively manufactured, and have stability when filled and unfilled, and an extensive variety of container designs have been developed by those working in the art to meet these needs.

Such containers have most frequently been manufactured from plastic materials such as polyethylene terephthalate (PET) by, for example, blow molding a parison of PET into a mold formed in the shape of the container. The biaxial expansion of PET by blow molding imparts rigidity and strength to the formed PET material, and blow molded PET can provide economically acceptable wall thicknesses, an attractive container with clarity in relatively intricate designs, sufficient strength to contain pressures up to 100 psi and more, and resistance to gas passage that may deplete contained beverages of their carbonation.

One factor that is, however, frequently over looked in container designs of those working in the art is the propensity of PET to succumb to the deleterious effects of stress cracking and crazing, which is manifest as almost imperceptible streaks in the plastic but ultimately can become complete cracks due to stress and other environmental factors. Relatively unstretched portions of a plastic container that have low degrees of crystallinity due to the lack of biaxial expansion, such as the central bottom portion, are particularly susceptible to crazing and stress cracking. The relatively unstretched central portion of the container bottom is also frequently provided with a plurality of depending feet that are formed with distention-resistant but stress concentrating areas, and the composite effect on such areas of stress and strain due to the internal pressure of the container and external environmental factors, such as exposure to stress cracking agents (e.g., caustics, water, oils and generally any plastic solvent or softening agent), can lead to crazing, stress cracking and container bottom failure.

One commercial cylindrical beverage container that seeks to avoid such problems is formed with a full hemispherical bottom portion and provided with a separate plastic base member fastened over the hemispherical bottom portion to provide a stable base for the container. Such containers are in common use for large multi-liter containers for carbonated beverages, even though the provision of a separate plastic base member imposes increased container height, and increased manufacturing and material costs on the cost of each container. Offsetting somewhat the increased costs imposed by the addition of a separate base piece, is the fact that use of a hemispherical bottom portion can permit a reduction in the bottom wall thickness, tending to maximize the containable pressure for a given wall thickness in the bottom portion and reducing the cost of the plastic material in the container portion.

Those working in the art have also generated commercial containers including "champagne" type bases including concave, or "domed" eversion-resisting central bottom portions merging with the cylindrical container sidewalls at an annular ring which forms a stable base for the container. The central domed portion of a champagne-based plastic container generally creates clearance for the gate area of the container which is intended to resist deformation due to the internal pressure of the container but is sensitive to stress cracking. Unfortunately, containers with champagne bases require a greater wall thickness in the base portion to resist the distending and everting forces of the internal pressure and form stress concentrations at the annular base-forming transition between the concave central bottom portion and cylindrical sidewall that are prone to stress cracking and rupture when the container is dropped. One container design addressing this problem is disclosed in U.S. Pat. No. 4,249,666.

Notwithstanding their champagne bases, it is not uncommon, however, particularly during hot summer months, for the bottoms of such commercial containers to distend and increase the internal volume enough to significantly lower the fluid level, creating an unacceptable product presentation to the consumer, and in some cases to expand beyond their intended bases, creating unstable and unacceptable "rockers".

More recently, the use of hemispherical bottom portions and concave champagne-like bottom portions have been combined by workers in the art in designs in which a plurality of feet are formed in the bottom of a blow molded container. These designs frequently seek eversion-resistant concave central bottom portions formed by a plurality of surrounding feet that are interconnected by a plurality of generally downwardly convex hemispheric rib portions. Many of such container designs providing footed bottles are in commercial usage.

Such container designs, however, are still subject, in the absence of relatively thick bottom wall portions, to distention of their concave central portions due to high internal pressures that can create "rockers" and significantly increased interior container volume with lower fluid levels, all of which are unacceptable to purchasers. Efforts to increase the eversion and distention resistance of the concave bottom portions of such footed containers with thinner bottom wall thicknesses have frequently led to bottom portions including small radii of curvature and discontinuous and abrupt transitions between adjoining surfaces that provide stress concentration, crazing and stress cracking sites. Some container designs, for example, those of U.S. Pat. Nos. 4,865,206 and 5,353,954, have addressed the problem of stress concentration, stress cracking and impact resistance. None of these container designs is entirely satisfactory in view of cost, manufacturability and reliability.

It is also desirable that such plastic containers provide maximal volumes with minimal heights, easily handled diameters and maximal height cylindrical sidewalls to provide large surface areas for product labelling. The achievement of such desiderata dictates that the bottom portions of such plastic containers consume minimal portions of the container height, which is inconsistent with the use of downwardly convex hemispheric rib portions between the cylindrical sidewall and the central portion of the bottom.

SUMMARY OF THE INVENTION

The invention provides plastic containers for carbonated beverages with low cost and weight, manufacturable from plastic material by blow molding with minimal plastic material in their walls, with maximal volumes with minimal heights in easily handled diameters, with maximal height cylindrical sidewall portions, with excellent stability in both filled and unfilled conditions because of their wide foot spans and their resistance to distention of their bottom portions, and with durability because of their relative freedom from excessively high stress concentrations, crazing and stress cracking.

The invention provides a plastic container base with hollow feet-forming portions and intervening downwardly convex, smoothly curving bottom segments which can provide, through a container bottom section of minimal height, substantially maximal container volume for a given container height, a maximal cylindrical sidewall labelling height, and a lower center of gravity and wide foot print for greater container stability, when filled and unfilled, and with minimal stress concentrations and risk of stress cracking and substantial resistance to distention due to internal pressure.

In accordance with the invention, the container bottom portion is formed with a plurality of hollow foot-forming portions and a plurality of intervening downwardly convex radially extending strap-like segments that are smoothly curved over, primarily, their portions extending from the center of the container bottom to adjacent the cylindrical sidewall. By smoothly curved, we mean the portions of the downwardly convex strap-like segments that extend outwardly and upwardly from the container center to adjacent the container sidewall comprise, in cross-sections in planes coplanar the containers longitudinal axis and their central regions, curves formed with a constant radius of curvature, or with a continuously varying radius of curvature, or compound curves formed with a plurality of curved sections having differing radii of curvature that are free of non-tangential mergers (i.e., the curved sections are tangent at their points of merger). In smaller containers, the downwardly convex smoothly curved cross-sections can be circular, providing spherical segments. In larger containers, the downwardly convex smoothly curved segments can comprise in cross-section preferably hyperbolic portions developed to be tangent at the longitudinal axis of container to a plane parallel with the plane common to the container feet, and approach tangently to the vertical cross-section of the cylindrical sidewall at their upper portions, or elliptical portions developed to tangent to a plane parallel with the plane common to the container feet at the longitudinal axis of the container and tangent to the vertical cross-section of the cylindrical sidewall at their upper portions. In such larger containers, which include, for example, containers having a volume, for example, in excess of about 0.6 to about 1 liter, or containers having a maximum diameter, for example, in excess of about 8 centimeters (about 3 inches), bottom portions that are formed with smoothly curved downwardly convex segments with hyperbolic or elliptical cross-sections in their central portions can reduce the height of the bottom container portion by a maximal fraction of an inch, can be substantially free of excessive stress concentrations with reduced crazing and risk of stress fractures, and when combined with hollow feet-forming portions, as described below, can support the internal container pressures generated with carbonated beverages without unacceptable distention of the bottom portion and provide containers with increased volume per unit of container height, larger labelling surfaces, a lower container center of gravity, and increased container stability when both filled and unfilled.

One plastic container of the invention comprises an upper mouth-forming portion, a cylindrical sidewall portion and a lower bottom-forming portion that includes a plurality of circumferentially-spaced, downwardly convex segments extending downwardly from the cylindrical sidewall and a plurality of intervening, circumferentially-spaced, totally convex, hollow foot-forming portions that extend radially from the central bottom portion and downwardly from the downwardly convex segments to form a clearance for a concave central bottom portion.

In such containers each of the circumferentially spaced, downwardly convex segments has a smoothly curved cross-section, in a plane through its central region and coplanar with the longitudinal axis of the container. In some preferred containers with diameters less than about 3.27 inches, the smoothly curved cross-section is circular, and in some preferred containers with diameters greater than about 3.27 inches, the smoothly curved cross-section is hyperbolic or elliptical. In addition, in some preferred containers, the downwardly convex segments can be flared at their upper extents where they merge with the container sidewall, for example, expanding outwardly by over 200 percent, and frequently up over 400 percent, in sidewall mergers that are relatively free of stress concentration.

In preferred such containers, the clearance-forming portions of the foot-forming bottom portions can include compound-curved offsets formed with opposing radii of curvature of a substantial fraction of an inch, preferably a maximal substantial fraction of an inch, the compound-curved offset curving downwardly and outwardly from the central bottom portion, about a center of curvature below the bottom-forming portion before curving about a center of curvature above the bottom-forming portion. The opposing radii of curvature preferably lie in a range of about 15 percent to about 30 percent of the contact diameter of the foot-forming bottom portion.

A preferred plastic container of the invention, comprises, in addition to an upper mouth-forming portion and a cylindrical sidewall portion all about a central longitudinal axis, a lower base-forming portion including a plurality of hollow foot-forming portions extending outwardly from the central portion of the lower base-forming portion to form a plurality of feet, each foot-forming portion including between said central portion of the base-forming portion and its foot, a bottom clearance-forming portion including a compound-curved offset formed by opposing radii of curvature of a substantial fraction of an inch, said compound-curved offset curving downwardly from said central portion about a radius of curvature below the bottom of the base-forming portion before curving about a radius of curvature above the bottom of the base-forming portion, and further comprises a plurality of smoothly curved, downwardly convex segments between adjacent pairs of hollow foot-forming portions, each of said downwardly convex segments extending upwardly between said adjacent hollow foot-forming portions and, preferably, expanding outwardly at its upper end to merge into said cylindrical sidewall portion. In smaller containers, such as 20 ounce containers having a sidewall with a diameter less than about 3.27 inches, e.g., about 2.90 inches, the downwardly convex segments can have circular cross-sections in their central portions, and in larger containers, such as two liter containers having a sidewall with a diameter greater than about 3.27 inches, e.g., about 4.28 inches, the downwardly convex segments can have hyperbolic cross-sections in their central portions. Furthermore, in preferred such containers the opposing radii of curvature of said bottom clearance forming portions are a maximal substantial fraction of an inch.

In describing the invention, "totally convex" means that, as viewed from the exterior of the container, a surface is defined in its curved portion, or portions, by radii that extend from the interior surface of the container away from the eye of the observer, and such radii are referred to herein as "internal radii". "External radii", are, therefore, radii extending from the exterior surface of the container toward the eye of such an observer. "Opposing radii" means radii extending from opposite sides of a surface and defining tangent circles (i.e., a combination of an external and an internal radius that merge tangentially to form a compound-curved surface). In addition, references to cross-sections of container portions means that cross-section that lies in a plane that includes (i.e., is coplanar) with the longitudinal axis of the container, unless otherwise defined.

Further embodiments, features and advantages of the invention will become apparent from the drawings and the following more detailed description of a preferred embodiment of the invention.

DETAILED DESCRIPTION OF THE DRAWINGS

Figure 7A:
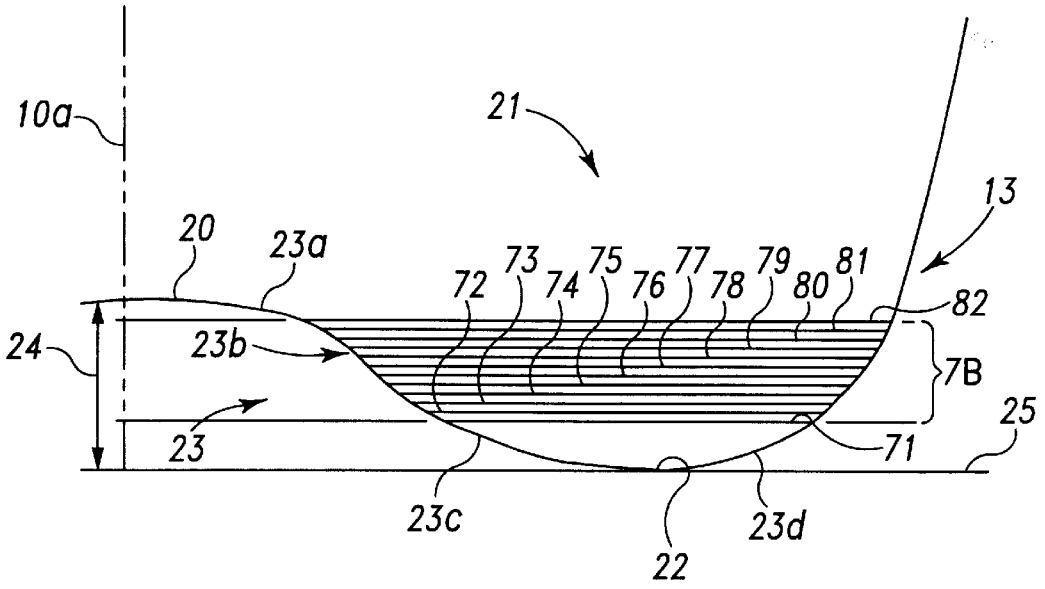
FIG. 7A is a cross-sectional view of a foot-forming portion of the containers of FIGS. 1–6 with a series of orthogonal cross-sectional planes 7B to further illustrate the foot-forming portion.
Figure 7B:
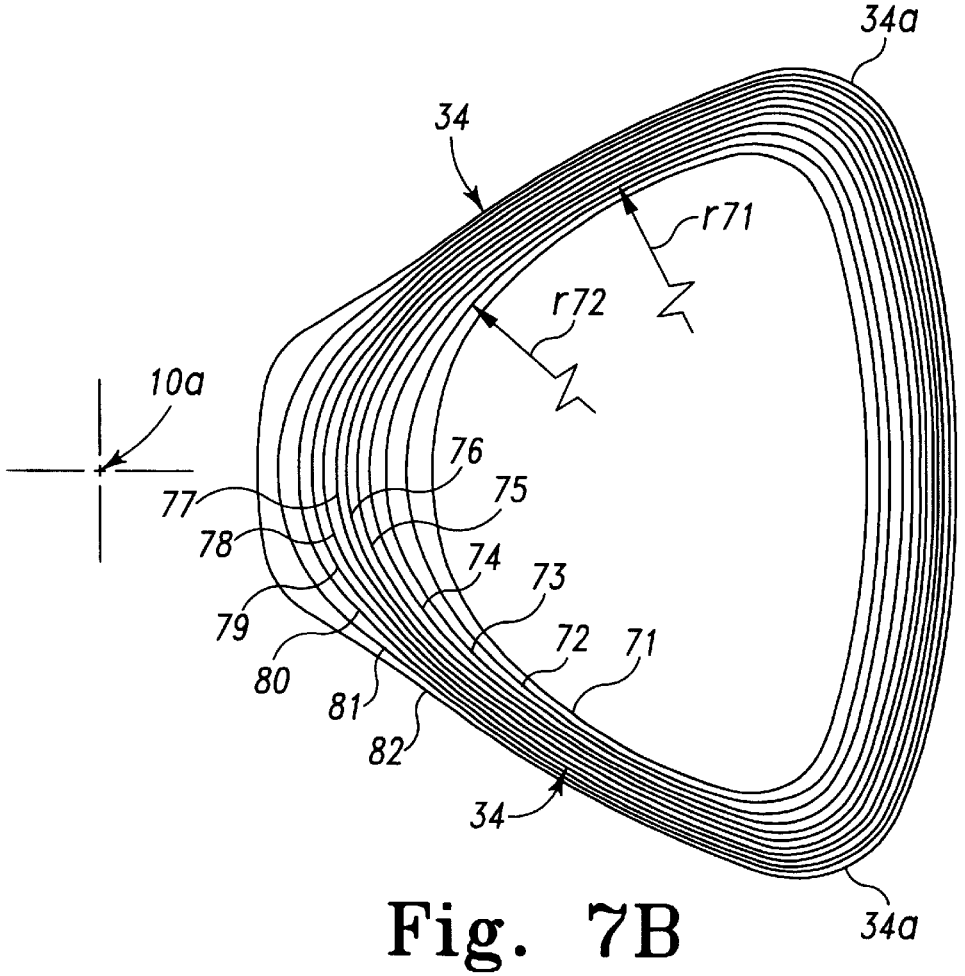
Figure 8:
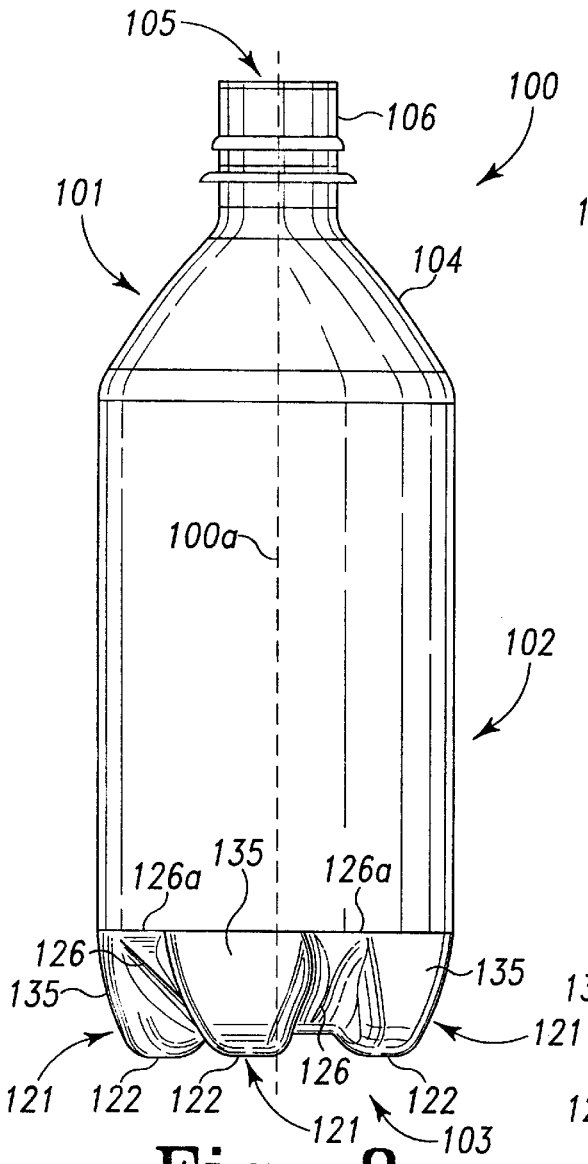
Figure 10:
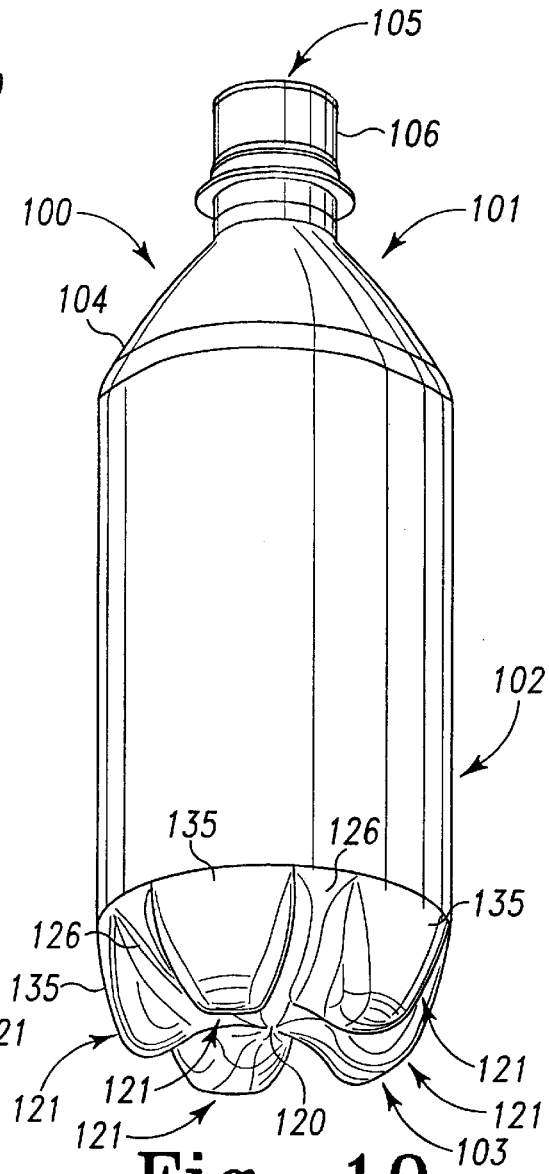
Figure 9A:
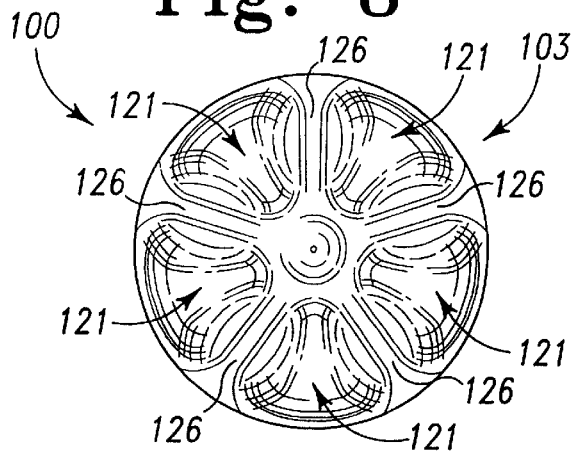
Figure 9C:
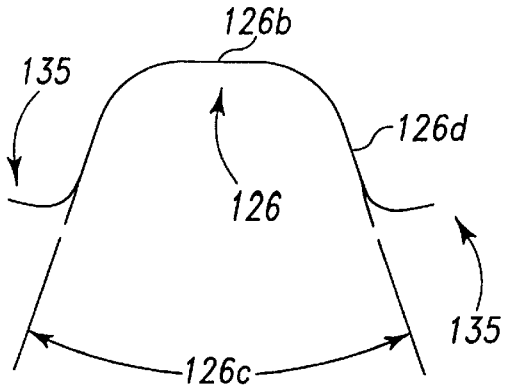
Figure 9B:
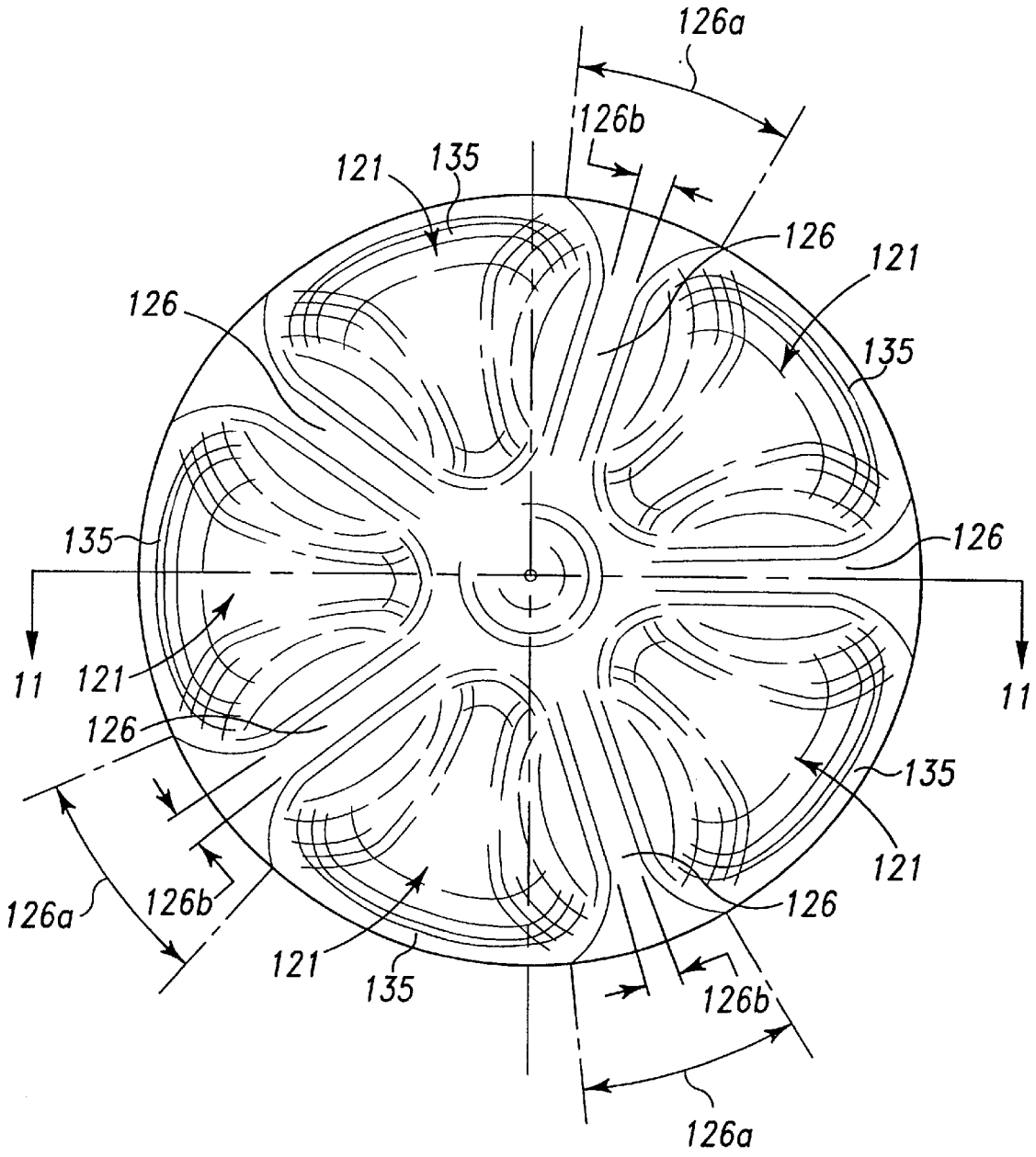
Figure 11:
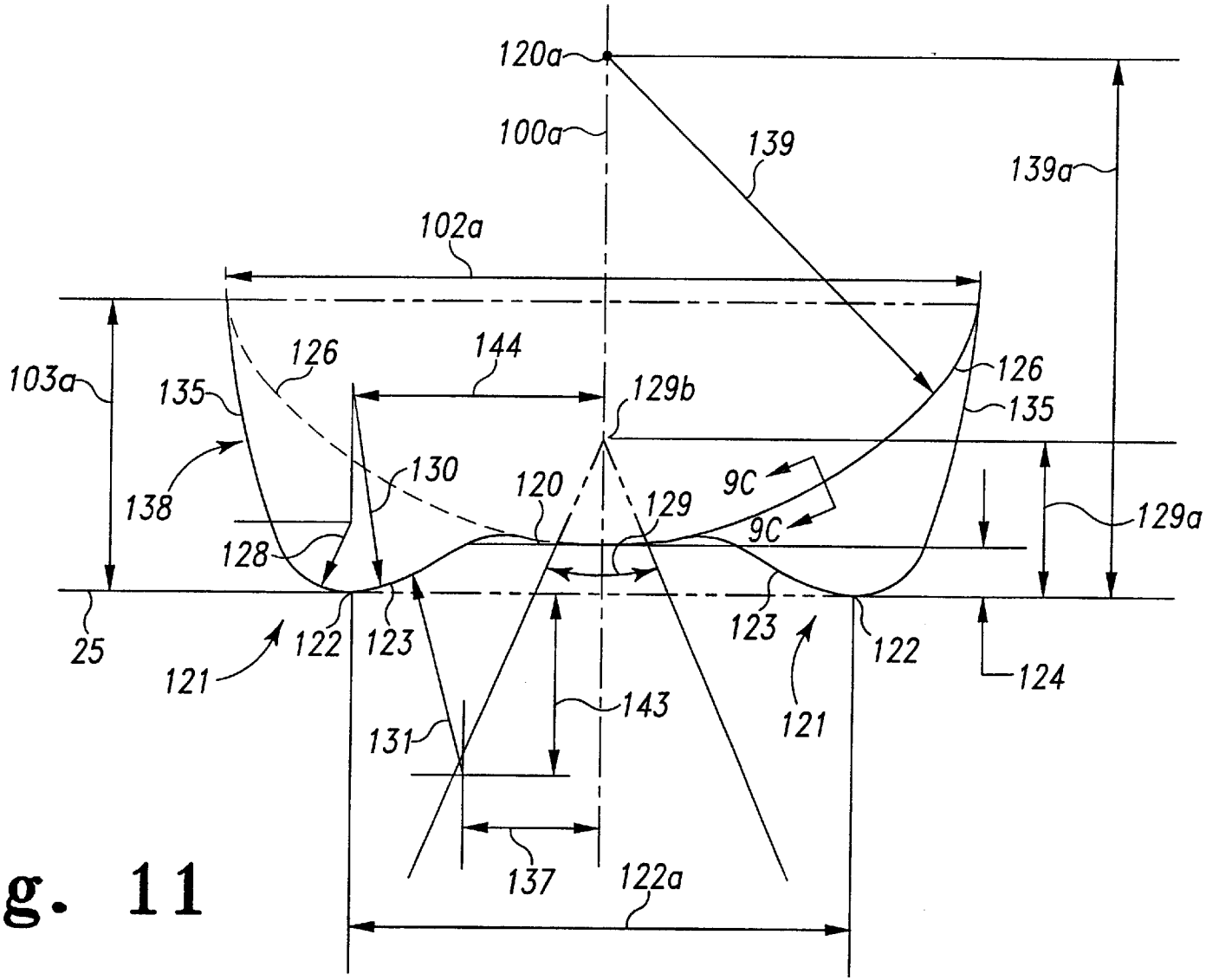
Figure 12:
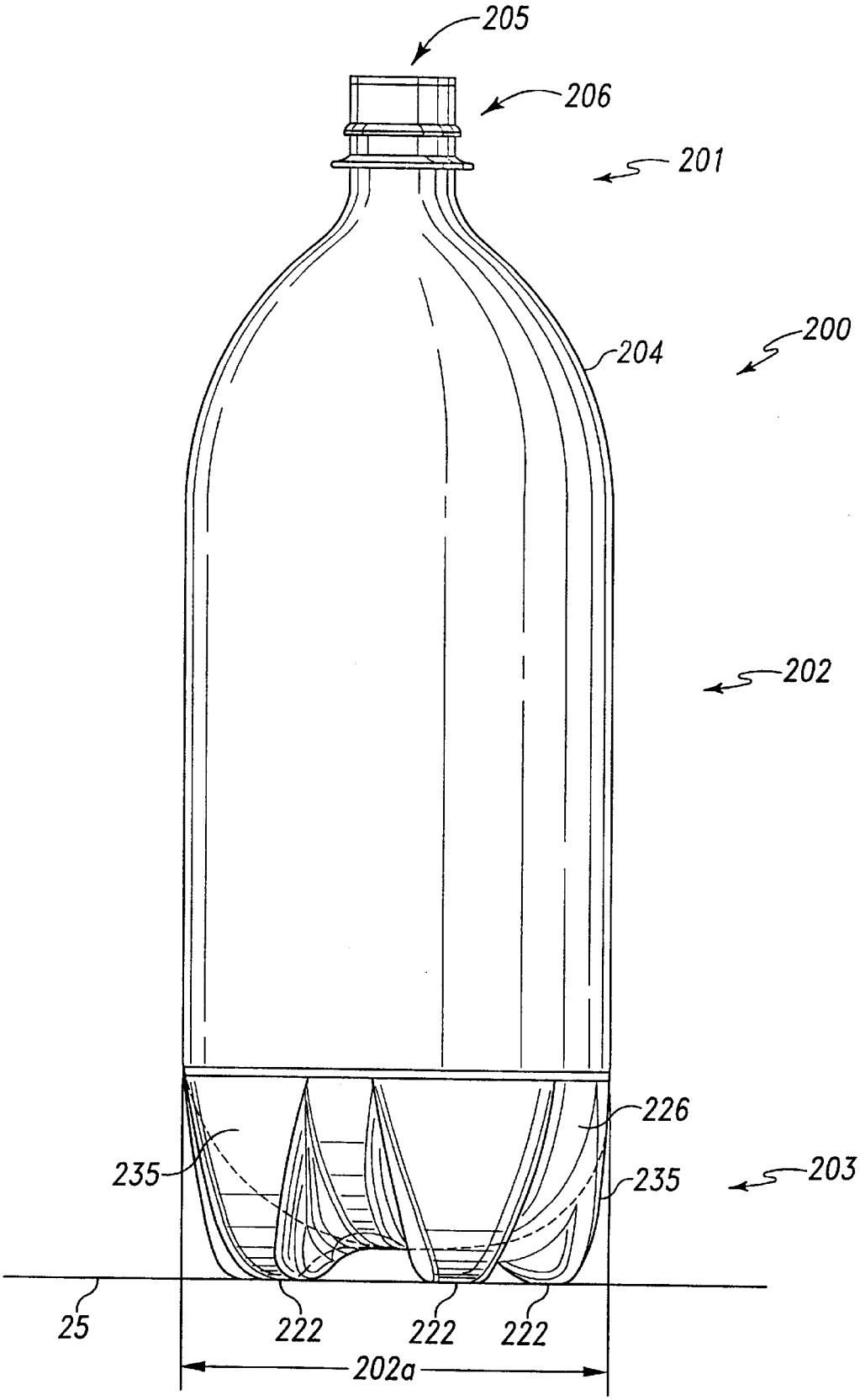
Figure 13:
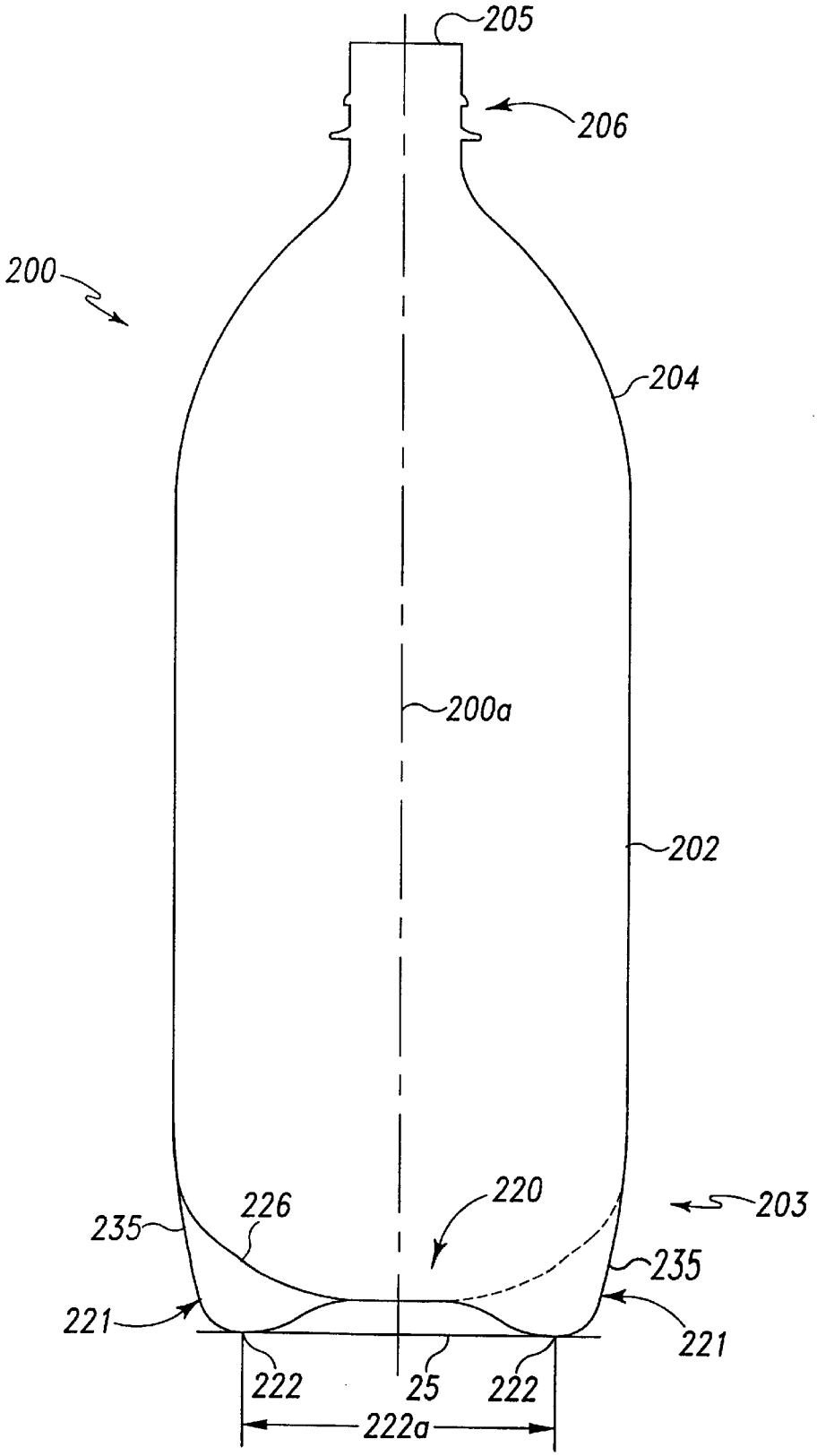
Figure 14:
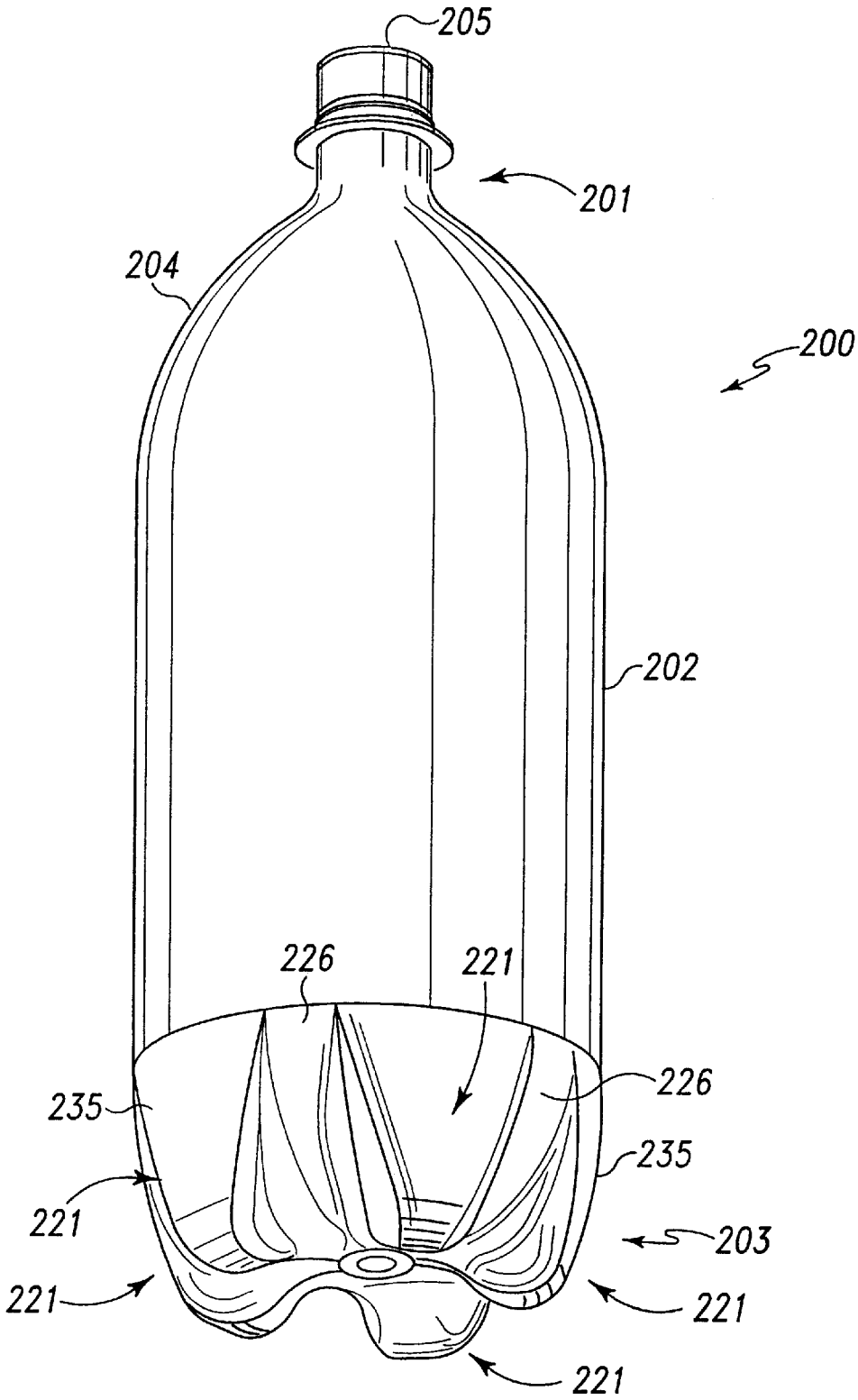
Figure 15A:
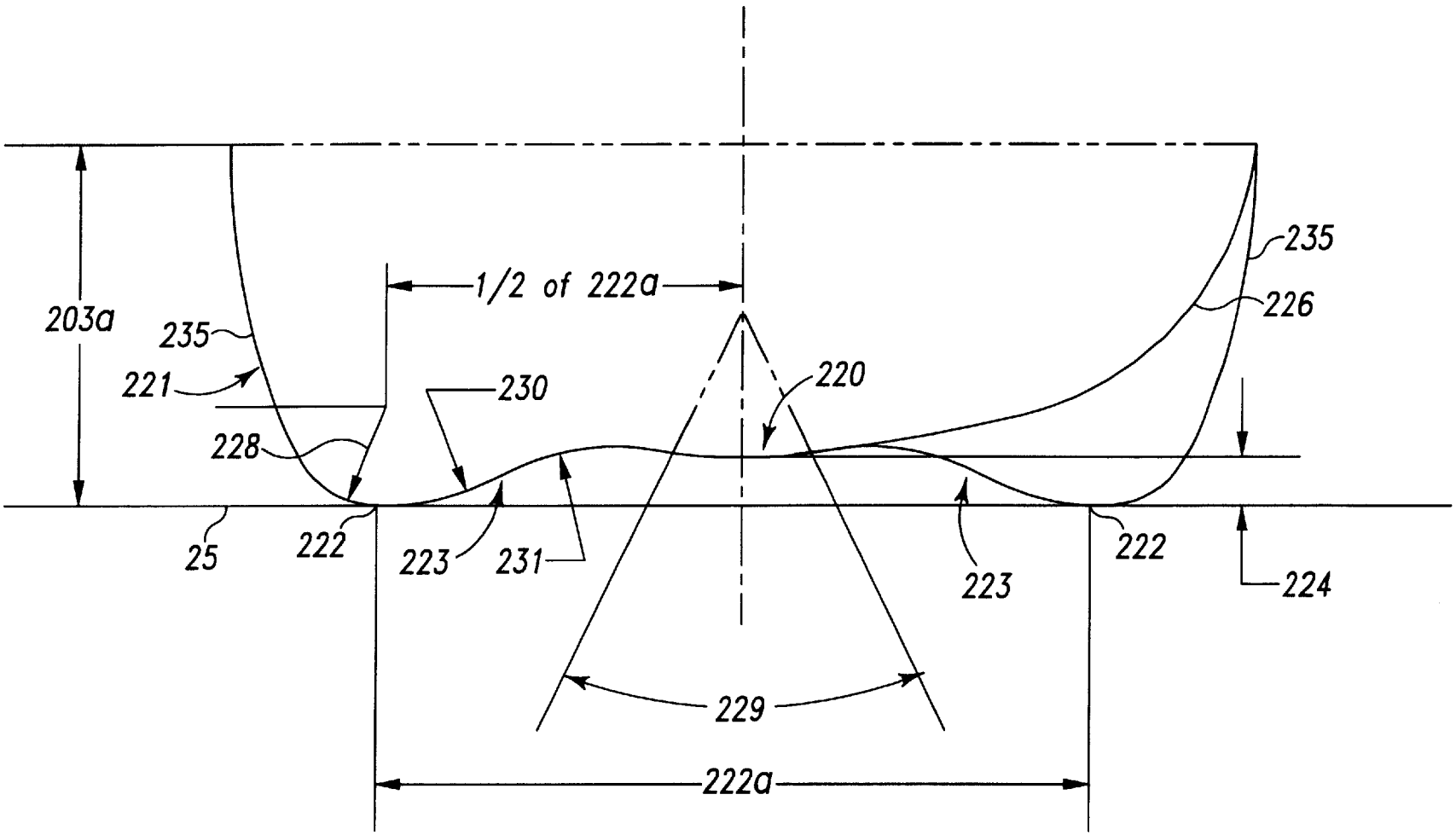
Figure 15B:
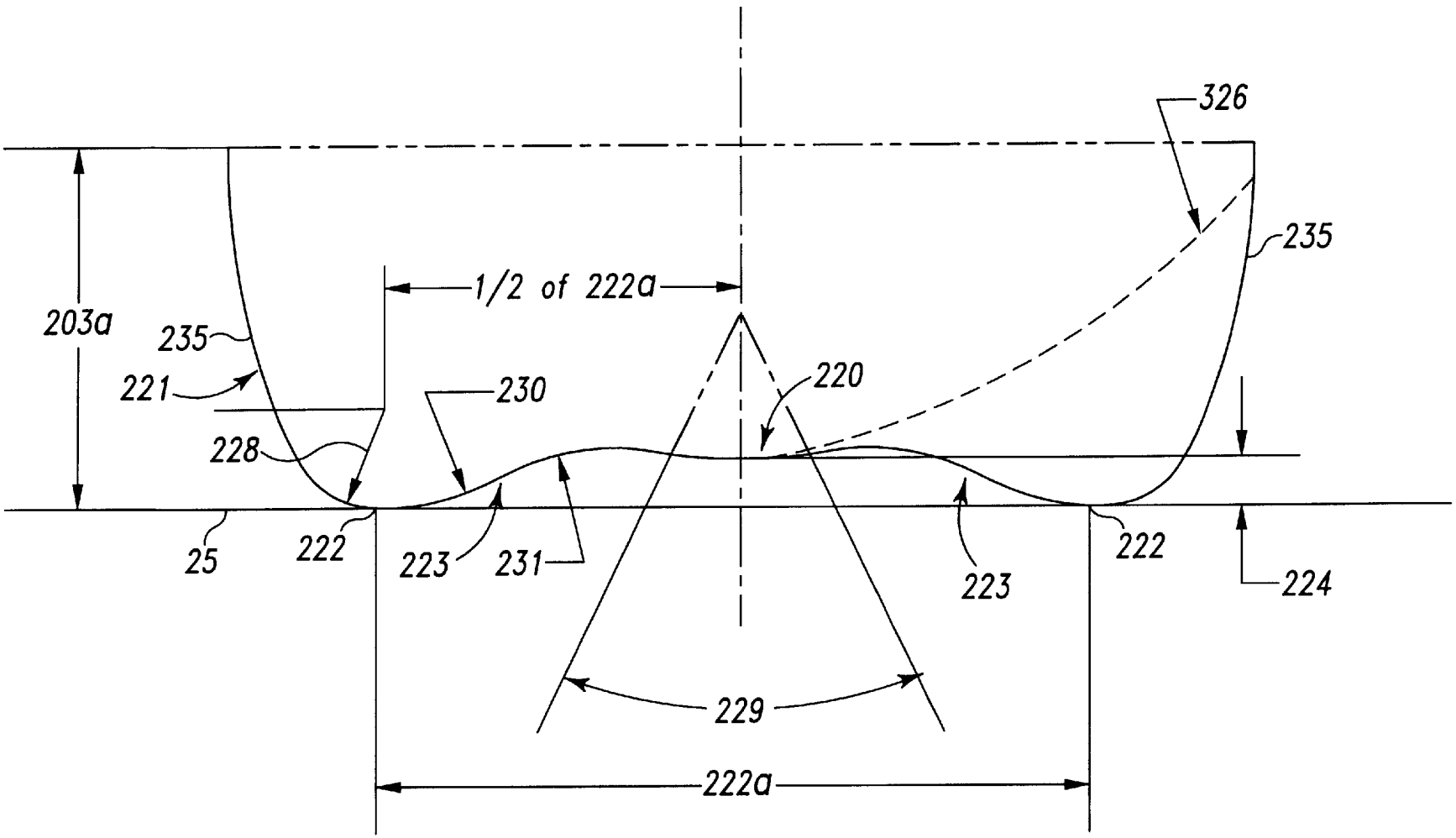

FIG. 7B comprises a series of cross-sections taken orthogonal to FIG. 7A at the series of planes 7B;

FIG. 8 is a side view of a preferred smaller container of the invention;

FIG. 9A is a bottom view of the container of FIG. 8;

FIG. 9B is an enlarged view of FIG. 9A to illustrate a preferred flaring of the downwardly convex, strap-like segments of the bottom;

FIG. 9C is a partial cross-sectional view of the downwardly convex strap-like segments of the container bottom in FIGS. 8–11 taken at the partial plane 9c—9*c* of FIG. 11;

FIG. 10 is a perspective view of the container of FIGS. 8 and 9 from below the container to further illustrate a container base of this invention;

FIG. 11 is a cross-sectional view of the bottom of the container of FIGS. 8–10 taken at a plane coplanar with the longitudinal axis of the container and through the central portion of a foot-forming portion, as indicated by line 11—11 of FIG. 9B;

FIG. 12 is a side view of a preferred larger container of the invention;

FIG. 13 is a cross-sectional view of the container of FIG. 12 taken at a plane coplanar with the container's longitudinal axis and the central portions of one of its downwardly convex bottom segments and one of its hollow foot-forming portions;

FIG. 14 is a perspective view of the container of FIGS. 12 and 13 from below the container to further illustrate a container base of this invention; and FIG. 15A illustrates the cross-sections of smoothly curved downwardly convex segments of the container of FIGS. 12–14, FIG. 15B illustrates the cross-sections of smoothly curved downwardly convex elliptical segments.

Figure 15C:
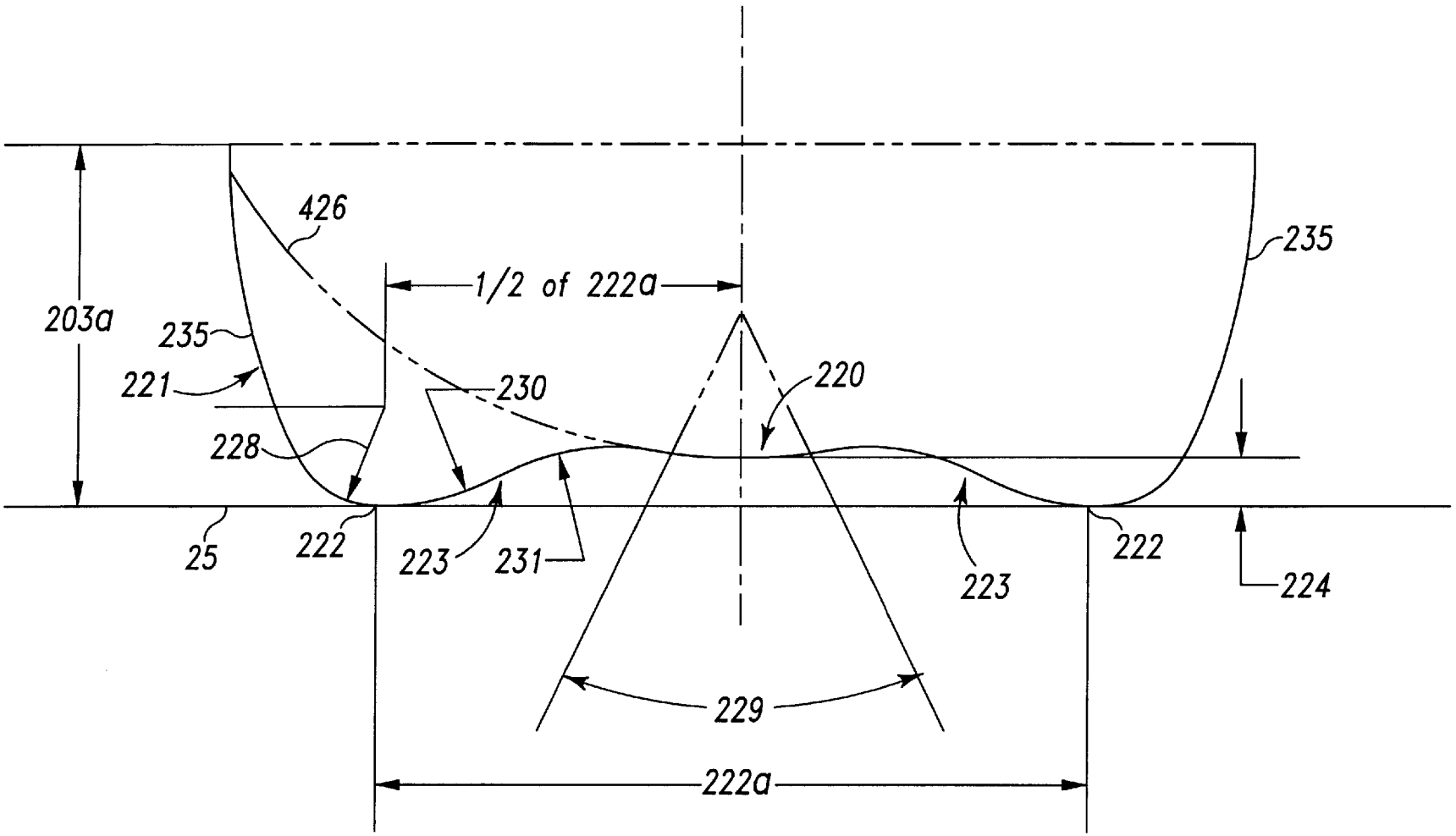

FIG. 15C illustrates the cross-sections of smoothly curved downwardly convex compound segments.

DETAILED DESCRIPTION OF THE INVENTION

FIGS. 1–7B illustrate a container 10 of this invention in the form of a plastic carbonated beverage bottle which can have a capacity of two liters.

Figure 1:
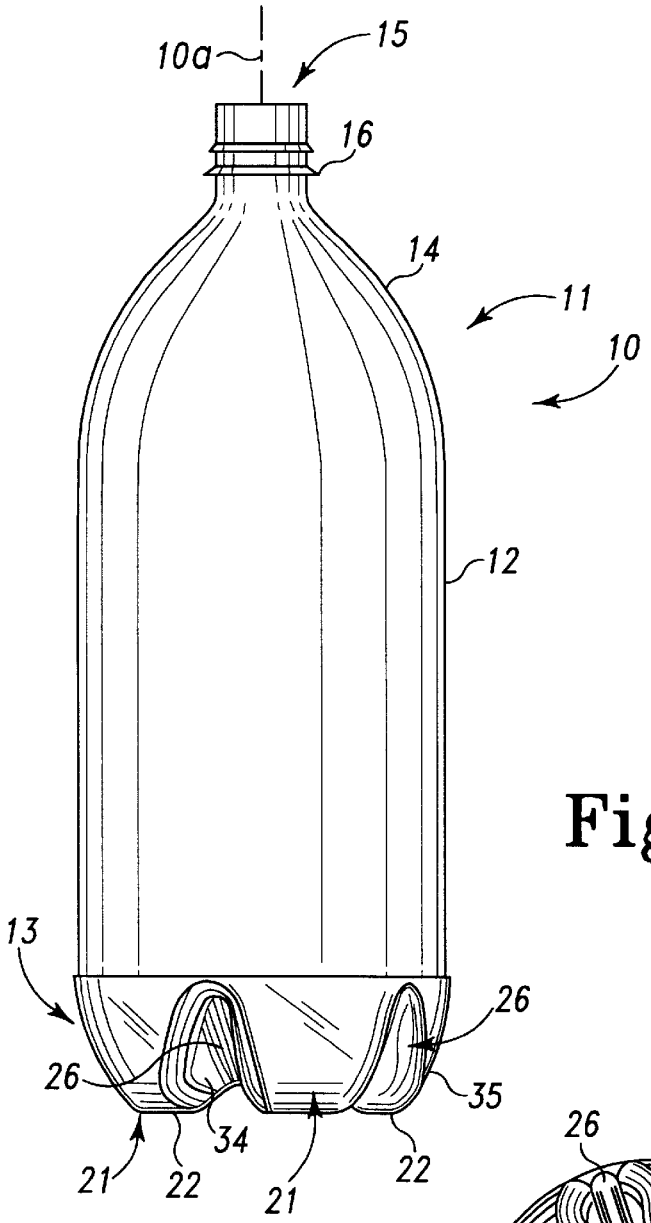
FIG. 1 is a side view of a container of the invention.
Figure 3:
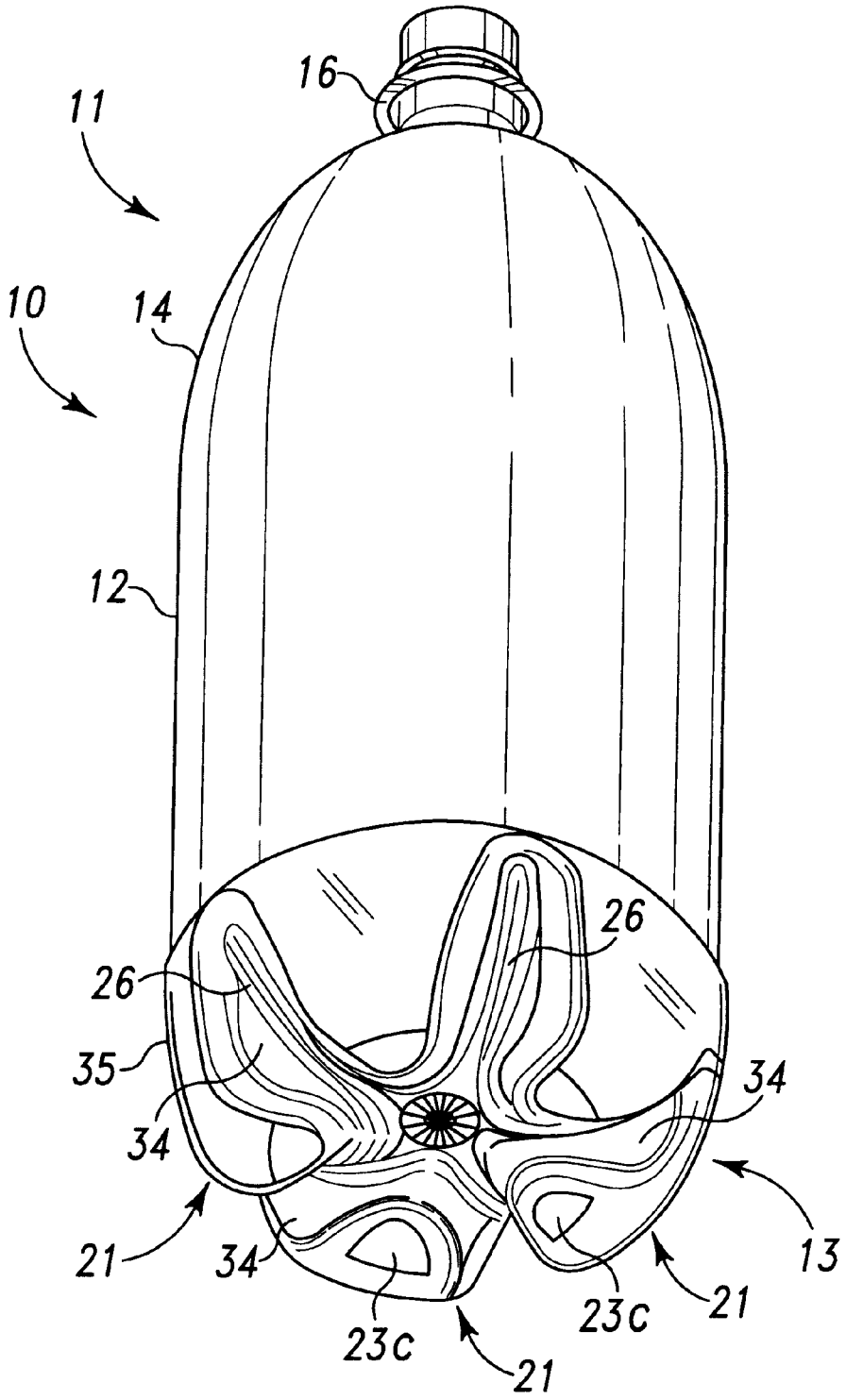
FIG. 3 is a perspective view of the container of FIGS. 1 and 2 from below the container to illustrate a container base of this invention.

As shown in FIGS. 1 and 3, such a container 10 includes an upper neck and mouth-forming portion 11, a cylindrical sidewall portion 12 extending around the longitudinal axis 10*a* of the container, and a lower base-forming portion 13. The upper portion 11 provides a neck-forming transition 14 leading to the container mouth 15. The transition portion 14 of a container of the invention may take any conveniently usable and moldable shape such as a frustoconical, hemispherical, ogive or other shape as may be selected by a container designer. The finish 16 of the container adjacent the mouth 15 is shown as threaded to accept a threaded cap commonly used to close carbonated beverage bottles; however, the mouth-forming portions of containers of the invention may be provided with means to accommodate other closures than threaded closures, as apparent to those working in the art.

As shown in FIGS. 1–5 and 7A, the bottom portion 13 of the container 10 includes a central portion 20 and a plurality of foot-forming portions 21 formed about the central portion for supporting the container 10. The foot-forming portions 21 extend downwardly and are spaced between a plurality of convex, circumferentially-spaced, spherically-shaped segments 26 that extend downwardly from the cylindrical sidewall 12. As indicated further below, such spherically-shaped segments are not preferred for larger containers such as two liter containers because they contribute an undesirable height to the bottom portion of such larger containers. The lower base-forming portion 13 of the container and its bottom, as provided with a plurality of hollow foot-forming portions 21, provides a stable container base and bottom clearance and rigidity to maintain the container stability when unfilled or filled without occurrence of stress concentrations, crazing and stress cracking.

Figure 4:
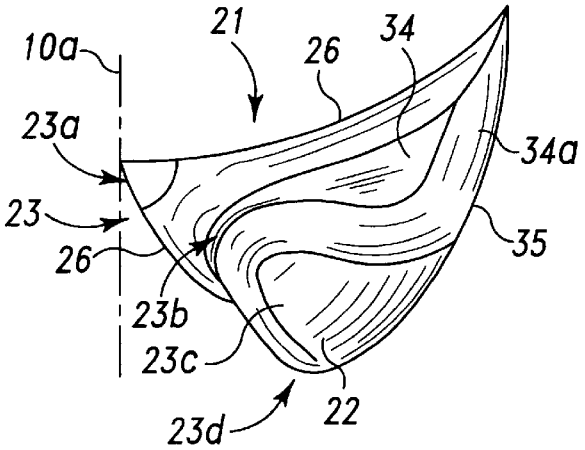
FIG. 4 is a partial perspective view from below of one foot-forming portion of the base of this invention as illustrated in FIGS. 1–3.
Figure 5:
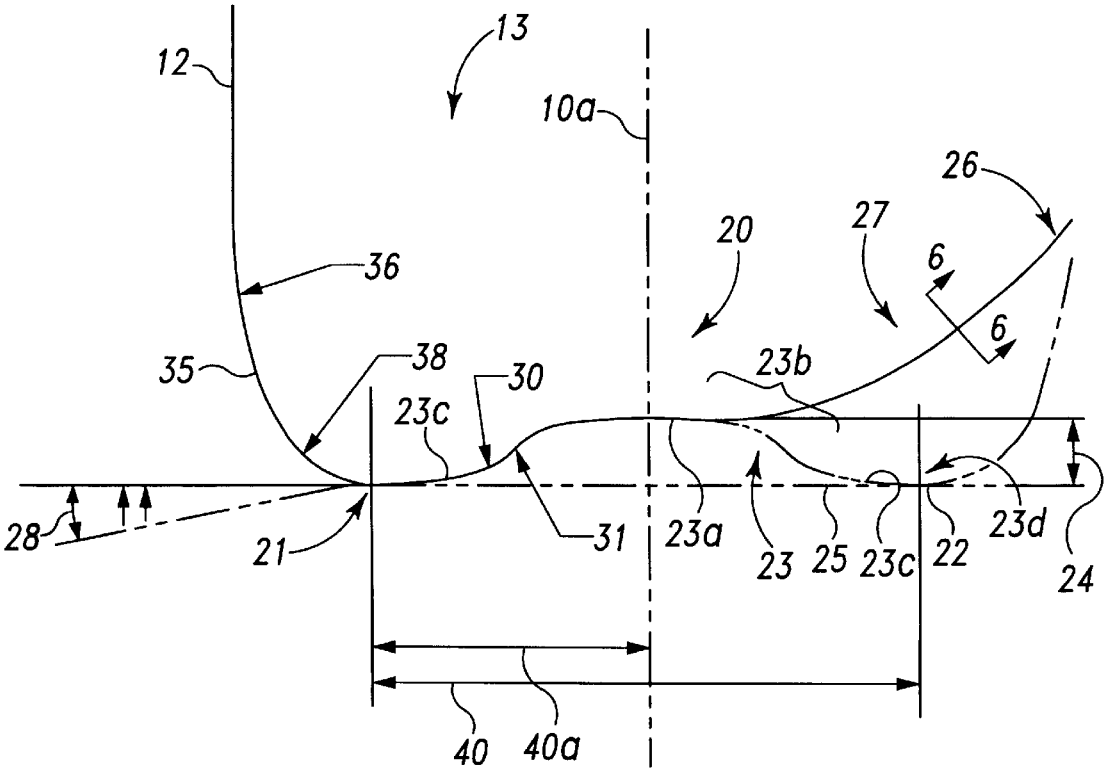
FIG. 5 is a cross-sectional view of the bottom of the container of FIGS. 1–4 taken at a plane coplanar with the longitudinal axis of the container and through the center of a foot-forming portion, as indicated by line 5—5 of FIG. 2.

Foot-forming portions 21 of containers of the invention are shown in greater detail in the cross-sectional drawing of FIG. 5, the perspective drawing of FIG. 4, and the cross-sectional drawings FIGS. 7A and 7B. Each foot-forming portion 21 includes a clearance-forming portion 23 extending from the longitudinal axis 10*a* of the container to adjacent each of the supporting feet 22. As described in greater detail below and as shown in FIGS. 3–5, the clearance-forming portion 23 of each foot-forming portion 21 provides a substantial clearance height 24 between the central portion 20 of the container bottom and the plane 25 of the supporting feet 22 and includes a distention resistant, compound-curved offset 23*b* formed with opposing radii of curvature and curving downwardly and outwardly first about a center of curvature 31 below, and then about a center of curvature 30 above, the compound-curved intermediate portion 23*b* to contribute a substantial portion (e.g., 30 to 50 percent) of the clearance height.

As more clearly shown in FIG. 4 and the cross-section of FIG. 5, a preferable clearance forming portion 23 of foot-forming portion 21, in extending radially and downwardly from the central longitudinal axis 10*a*, comprises three contiguous regions along its lowermost surface. The three lowermost regions are a slightly downwardly curved, central, spherical portion 23*a* centered on the longitudinal axis 10*a*, the compound-curved offset 23*b*, and an outermost, and a lowermost slightly descending portion 23*c* extending outwardly from the compound-curved offset portion 23*b* to a supporting foot 22 and merging into an outer curved portion 23*d* extending from the supporting foot 22 upwardly and outwardly toward the container sidewall 12.

As shown best in FIGS. 5 and 7A, clearance 24 is provided by the descending surface portions 23*a* and 23*c* and the offset ramp-like intermediate portion 23*b*. In this preferred container of the invention, the angle of descent 28 (FIG. 5) of clearance-forming portions 23*c* is preferably about 10 degrees to 15 degrees, although other angles of descent may be used in the invention depending upon the diameter of the container, the internal pressure to be contained and the bottom clearance required. As shown in FIG. 5, compound-curved offset portion 23*b* is preferably formed with opposing radii of curvature 30 and 31 of a substantial fraction of an inch. A "substantial fraction of an inch", as used in this application, means from about 0.1 inch to about 0.6 inch. In containers of the invention, the offset portion 23*b* between central portion 23*a* and portion 23*c* can contribute a substantial fraction of an inch to, and a substantial portion of, the clearance distance 24 and can also contribute distention-resistance in the foot-forming portion 21 of the container. The outwardly and upwardly extending bottom surface portion 23*d* extending from the supporting feet 22 are also preferably formed with radii of curvature 38 of a substantial fraction of an inch.

Figure 2:
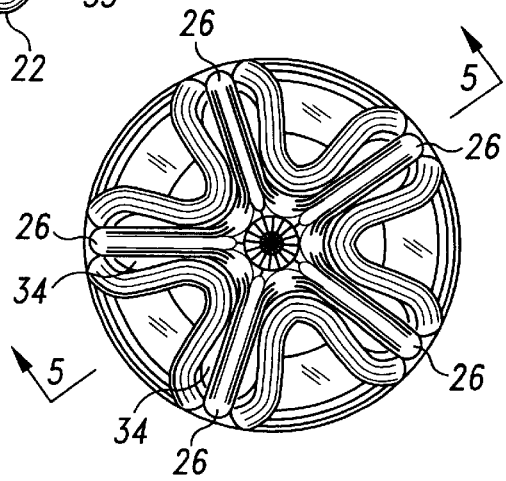
FIG. 2 is a bottom view of the container of FIG. 1.

As shown in FIGS. 2–4, 7A and 7B, each of the plurality of foot-forming portions 21 preferably extends radially, circumferentially and downwardly between the intervening, generally spherical segments 26 of a spherical bottom configuration 27. The surface portions indicated as 23*a*, 23*b*, 23*c* and 23*d* in the perspective view of FIG. 4 correspond to the four regions 23*a*, 23*b*, 23*c* and 23*d* of the cross-sections of FIGS. 5 and 7A. As shown in FIGS. 2–4, surface portions 23*c* are, preferably, substantially planar. "Substantially planar" portions of containers of this invention comprise those relatively flat wall portions having minimum radii of curvature of several times the radius of the cylindrical container sidewall in orthogonal directions.

Thus, as illustrated by the perspective view of FIG. 4, the foot-forming portions 21 of the invention (only one of which is illustrated in FIG. 4) preferably expand circumferentially as they extend radially outwardly and include saddle-shaped transitions extending downwardly a substantial fraction of an inch from the concave central spherical portion 23*a* to the substantially planar third portions 23*c* of their clearance-forming portions. The saddle-shaped transitions are preferably formed with an external radii 31 (FIG. 5) of a substantial fraction of an inch, and internal radii, in planes orthogonal to the longitudinal container axis, of at least a substantial fraction of an inch that extend from the interior of the foot-forming portions 21 toward their centers (see, for example, r71 and r72 of FIG. 7B). The saddle-shaped transitions curve smoothly into the substantially planar third portions 23*c*, with internal radii of curvature 30, and the saddle-shaped transitions, in combination with the curved transitions provide a substantial, distention resistant, offset of the central bottom portion 23*a*, and a substantial clearance height 24 between the feet 22 and the central bottom portion 23*a*.

As shown in FIGS. 1–4 and most clearly in FIG. 4, and as indicated in FIGS. 7A and 7B, the foot-forming portions 21 of the invention are substantially totally convex. As illustrated in FIGS. 7A and 7B, at cross-sections taken at planes 71–82 through the foot-forming portions 21 and across the longitudinal axis 10*a* and parallel to the plane 25 of the feet 22, the walls of the foot-forming portion are formed by surfaces curving outwardly from the container interior about internal radii (e.g., r71 and r72) extending within the foot-forming portions 21 at each cross-section 71 through 82, and the walls thus form substantially totally convex foot-forming portions (as can be seen from the perspective view of FIG. 4).

As indicated in FIGS. 1–4 and 6, the foot-forming portions 21 include substantially planar side panels 34 that blend into and join the spherical segments 26 of the container bottom. As indicated in FIGS. 1–4 and 7B, the outer surface portions 35 of foot-forming portions 21 are joined to the side panels 34 by curved transitions 34*a* that also preferably have a radius of curvature of substantial fraction of an inch. In addition, the outer surface portions 35 of the foot-forming portions 21 preferably have radii of curvature 36 in cross sections lying in planes coplanar with the longitudinal axis of the container substantially greater than the radius of the cylindrical sidewall 12, although surfaces 35 may be frustoconical surfaces merging into the cylindrical sidewall with an appropriate radius of curvature.

Such containers of this invention can provide both good resistance against base movement and resistance to crazing and stress cracking. In such containers of the invention, the central bottom portion 20, that is, the uppermost bottom surface 23*a*, does not move axially downward to such a degree that it becomes a contact surface for the container, and the foot contact diameter 40 remains largely unchanged even when the central region of the container bottom is distended under pressurization. Because of the plurality of totally convex offset transition portions 23*b*, containers of the invention can provide a greater clearance distance 24 between the central portion 20 of the bottom and the plane 25 of the supporting feet 22, reducing further the tendency for the creation of "rocker" bottles. In containers of the invention, foot-forming portions 21 are totally convex walls, formed by an internal radii of substantial fraction of an inch, creating the offset transition portions 23*b* to significantly reduce stress concentration in this relatively unexpanded central area of the container bottom and provide the bottle with improved stress crack performance without a loss of stability.

FIGS. 8–11 illustrate a presently preferred container of this invention in the form of plastic carbonated beverage bottle with a capacity of 20 ounces and a maximum container diameter of less than about 3.27 inches. The bottom portion of the container is drawn with a "wire frame" format to assist in the visualization of the invention.

As shown in FIGS. 8 and 10, such a container 100 includes an upper neck and mouth forming portion 101, a cylindrical sidewall portion 102 and a lower base part forming portion 103, all extending around a longitudinal axis 100*a* of the container. Tile upper portion 101 provides a neck-forming transition 104 leading to container mouth 105. The transition portion 104 of the container of the invention may take any conveniently usable and moldable shape, such as frustoconical, hemispherical, ogive or other shape as may be selected by the container designer. The finish 106 of the container adjacent the container mouth 105 may take any usable form that may accommodate means for closing the container, as is apparent to those working in the art. The lower base-forming portion 103 of the container, provides a stable container base and container stability and improved freedom from stress concentrations, crazing and stress cracking when filled with a carbonated beverage.

As shown in FIGS. 8–11, the bottom portion 103 of the container 100 includes a central portion 120 and a plurality of hollow foot-forming portions 121 formed about the central portion for supporting the container 100. The foot-forming portions 121 extend downwardly from, and are spaced between, a plurality of downwardly convex, spherically shaped segments 126 that extend upwardly between the adjacent hollow foot-forming portions and expand outwardly at their upper ends 126*a* to merge into the cylindrical sidewall portion 102. Each foot-forming portion 121 includes a clearance forming portion 123 extending from the central portion 120 of the container bottom to a supporting foot 122. The plurality of supporting feet 122 so formed lie on a contact diameter 122*a* (FIG. 11) that provides stable support for the container.

As shown in FIG. 11, and described in greater detail below, the clearance forming portion 123 of each foot-forming portion 121 provides a substantial clearance height 124 between the central portion 120 of the container bottom and the plane 25 of the supporting feet 122 and includes, preferably, a distension resistant, compound-curved offset 123 formed with opposing radii of curvature and curving downwardly and outwardly first about a center of curvature 131 below, and then about a center of curvature 130 above, the bottom surface the compound-curved offset portion 123 contributing the clearance height 124. The opposing radii of curvature are preferably within a range of about 15 percent to about 30 percent of the contact diameter in preferred embodiments of the invention, and may also lie within range of about 10 percent to about 20 percent of the outside diameter of the container in some embodiments.

As shown in FIG. 10 and more clearly in FIG. 11, the central portion 120 of the bottom portion 103 of the two liter container 100 can comprise a downwardly convex spherical surface 120 subtending a solid angle 129, preferably of about 50 degrees, as measured from a center 129*a*.

In the embodiment illustrated in FIGS. 8–11 where the downwardly convex segments are generally spherical segments with circular cross-sections, the circular cross-sections can share a common radius with the central spherical bottom portion 120 and extend therefrom upwardly between the hollow foot-forming portions 121 and flare or expand outwardly at their upper ends 126*a* in merging with the container sidewall portion 102. The downwardly convex segments 126 flare outwardly in merging with the container sidewall 102 and generally carry their share of the load in tension, and contribute a minimal stress concentration in merging with the container sidewall portion 102. In the embodiment of FIGS. 8–11, the downwardly convex portions 126 carry a greater portion of the forces imposed on the container bottom than, for example, the segments 26 of the container of FIGS. 1–7, in a manner that minimizes stress, contributes to maintenance of the clearance distance 124, and reduces stress/strain gradients.

As indicated in FIGS. 8–10 and shown in greater detail in FIG. 9B, the generally spherical, downwardly convex segments 126 flare outwardly as they extend upwardly for merger with the container sidewall portion 102, increasing in their angular extent by over 200 percent and preferably, by over 300 percent and up to about 400 to 500 percent. For example, as shown in FIG. 9B, the central portions 126*b* of the generally spherical, downwardly convex segments 126 can subtend an angle of about 7 to 8 degrees, and at their upper ends 126*a* where they merge into the container sidewall, the segments 126 can subtend an angle of about 20 to 30 degrees and preferably 30 degrees or over. The upper portions 126*a* of the downwardly convex, generally spherical segments 126 reduce the circumferential extent of the merger of the expansive outer portions 135 that result from the radial and circumferential expansion at the hollow foot-forming portions 121.

FIG. 9C is a partial cross-sectional view of the container bottom taken at a partial plane corresponding to the line 9*c*—9*c* of FIG. 11 to illustrate the cross-section of the central portions 126*b* of the downwardly convex, generally spherical segments 126 in planes that are generally tangential to a circle having its center on the longitudinal axis 120*a* at the container. The central portions 126*b* merge into portion 126*d* with external radii of a substantial fraction of an inch. The angle 126*c* formed by the container bottom transition from the strap-like portions 126 to the expansive outer portions 135 may be, for example, about 50 degrees.

Figure 6:
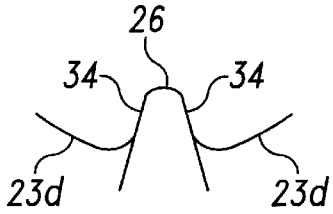
FIG. 6 is a partial cross-sectional view of a spherical segment of the container bottom of FIGS. 1–5 taken at the partial plane 6—6 of FIG. 5.

The downwardly convex segments 126 act like a plurality of straps extending from the cylindrical sidewall to the central bottom portion 120 transferring a portion of the force imposed on the bottom portion 103 as a result of the contents and internal pressure of the container to the container sidewall portion 102 in tension. The strap-like segments 126 eliminate the rigidifying rib-like portions frequently employed between the foot-forming portions of prior art containers, and reduce the high stress concentration regions associated with the use of such bottom portions formed with small radii curvature in an effort to rigidify the bottom, for example, in the container of FIGS. 1–7, by eliminating the sharply curved transition where the portions 26 of the container intersect and meet the cylindrical sidewall 12 of the container 10. As shown in FIGS. 1 and 3, the portions 26 of the container of FIGS. 1–7 do not flare or expand as they extend upwardly for merger with the sidewall portion 12 of the container 10. As shown in FIG. 6, the portions 26 are configured to rigidify the bottom portion 13 by bearing the loads imposed by the contents of the container and its internal pressure in compression.

Thus, in the preferred smaller container embodiment of FIGS. 8–11, the segments 126 are widened, using a spherical shape as a design basis and expanded at their upper ends 126*a* for merger with the sidewall. Localized stresses at the merger of the segments 126 with the sidewall portion 102 are substantially reduced. As shown in FIGS. 1 and 3, the portions 26 of the container of FIGS. 1–7 meet the cylindrical portion 12 of the container at a relative high angle of incidence and are blended at their interfaces with small radius fillets. In the preferred embodiment of FIGS. 8–11, the stresses and strains at the upper most portions of the segments 126 are significantly reduced and the load is more uniformly distributed through the plurality of segments 126. The strap-like segments 126 deviate from the ribs 26 of the container of FIGS. 1–7, which function as stiff members (such as C channels) where deformation is controlled through resistance to bending, and instead function as a straps in a state of tension where strain is controlled by uniform expansion under pressure.

The foot-forming portions 121 of the container of FIGS. 8–11, like the foot-forming portions 21 of the container of FIGS. 1–7, extend radially outwardly and downwardly from the central portion 120 to the supporting feet 122, and form between the supporting feet 122 and the central portion 120, the compound-curved, clearance-forming portion 123. The foot-forming portions 121 likewise expand circumferentially to expansive outer portions 135. As shown in FIG. 11, the compound-curved, clearance-forming portion 123 is preferably formed with opposing equal radii of curvature 130 and 131 which preferably lie in a range of about 15 percent to over about 30 percent of the contact diameter for the container feet, for example, in one container having a contact diameter with a contact diameter of 1.982 inch, opposing radii of curvature can have a maximal substantial fraction of an inch, e.g., about 0.6 inch to about 0.72 inch.

In the containers of FIGS. 8–11, the offset portions 123 between the central portion 120 and the feet 122 can contribute a clearance distance 124 of a substantial fraction of an inch, and in combination with the flaring strap-like segments 126 can contribute distension resistance in the foot-forming portions 121 of the container. As contrasted with the container of FIGS. 1–7, the central portion 120 of the bottom portion 103 comprises a downwardly convex spherical surface 120 supported by the plurality of downwardly convex, generally spherical segments 126 and the plurality of clearance forming portions 123 a substantial fraction of an inch above the supporting feet 122. The preferred embodiment of FIGS. 8–11 does not include the slightly downwardly curved, central spherical portion 123*a* of the container of FIGS. 1–7 and the plurality of foot-forming portions 121 do not include planar portions corresponding to portions 123*c* of the FIGS. 1–7, but instead, obtains the clearance distance 124 from forming compound-curved offset portions 123 with opposing radii of curvature 130 and 131 lying in a range of about 15 percent to over about 30 percent of the foot contact diameter.

These changes between the bottom portion 103 of the preferred embodiment of FIGS. 8–11 and the bottom portion 13 of the container of FIGS. 1–7 improve resistance to stress cracking in the amorphous gate area of the container which is generally in the central portions (20, 120) of the bottom portion of the container adjacent its longitudinal axis (10*a*, 100*a*). By providing the bottom portion 103 with a downwardly convex, spherical central portion 120 and employing such opposing radii to provide the clearance forming portions 123, stresses in the amorphous gate area are reduced and the higher stress regions in the bottom central portion 120 are moved outwardly from the longitudinal axis 100*a* to a more oriented and less amorphous region of the bottom 103.

EXAMPLE I

In a carbonated beverage bottle for containing 20 ounces, a plastic container of the invention can have an overall height of about 8.5 inches, for filling within about 1.63 inches of the mouth. Any finish 106 can be used with containers of the invention; one preferable finish for a carbonated beverage bottle can comprise a threaded opening, with a PCO-28 finish. The right circular cylindrical sidewall 102 can have a maximum diameter 102*a* of on the order of 2.89 inches and a reduced label panel diameter of 2.67 inches, and the neck-forming transition 104 between the cylindrical sidewall and the bottle mouth 105 can be, as shown, an ogive shape extending downwardly from about an inch below the mouth 105 of the bottle to blend into the cylindrical sidewall 102 approximately 3.03 inches below the mouth 105. Where the radius of curvature 139 of the hemispherical bottom portion 120 and the segments 126 equals about 1.75 inches and the clearance height 124 equals about 0.145 inches, the lower base-forming portion 103 of such a bottle can extend from the plane 25 of the supporting feet 122 upwardly a distance 103*a* about 1.01 inches.

The radius of curvature 139 of the convex spherical central portion 20 and the generally spherical, downwardly convex segments 126 can be about 1.75 inches and extend from a center located on the longitudinal axis 100*a* of the container at a distance 139*a* of about 1.895 inches above the plane 25 of the supporting feet 122. The convex spherical central portion 120 can subtend a solid angle 129 at about 50 degrees, taken from a center 129*b* located a distance 129*a* of 0.55 inch above the plane of the feet 122 and the longitudinal axis 100*a*. The opposing radii of curvature 130 and 131 can be equal and about 0.600 inch. The radius of curvature 131 can extend from a center located below the bottom wall and outwardly a distance 137 of about 0.368 inch from central longitudinal axis 100*a* of the container and located a distance 143 about 0.425 inch below the plane 25 of its feet 122, and the radius of curvature 30 can extend from a center located above the bottom wall and outwardly a distance 144 of about 0.991 inches from the center longitudinal axis 100*a* of the container and located a distance about 0.600 inches above the plane 25 of feet 122. The centers of the radii of curvature 130 and 131 can thus be located so that the offsetting transition surfaces 123 formed thereby merge smoothly (i.e., tangentially) with the spherical surface portion 120 formed by the radius of curvature 129 and with the outer surface portions of the feet 122 that are formed by interior radii 128. Together, the surfaces formed by radii of curvature 130 and 131 provide clearance distance 124. The supporting feet 122 lie on a contact diameter of about 1.982 inches about the longitudinal axis 100*a* of the container and provide a stable support for the bottle. The radius of curvature 138 of the outermost foot-forming surface 135 leading to cylindrical sidewall 102, is about 2.00 inch.

In the preferred embodiment of FIGS. 8–11, localized stress in the area where the segments 126 merge with the cylindrical sidewall 102 is reduced by about 12 percent, and with the use of opposing radii about 30 percent of the contact diameter of the container in forming the clearance forming portion of 123 of the bottom, stresses in the gate area are reduced from 19 to 43 percent, and strains from 33 to 60 percent, and the areas of maximum stress concentration were relocated away from the central axis 100*a* of the container.

FIGS. 12–14 illustrate another presently preferred larger 200 container of this invention in the form of plastic carbonated beverage bottle with a capacity of two liters and a diameter greater than about 3.27 inches, for example, about 4.28 inches. FIGS. 12 and 14 are also drawn in "wire frame" format to assist in visualization of the invention and FIG. 13 illustrates a cross-section of the container of FIG. 12 taken at a plane coplanar with its central axis longitudinal 200*a* and through the central portions of one of its downwardly convex bottom segments 226 and one of its hollow foot-forming portion 221.

As shown in FIGS. 12–14, the container 200 includes an upper neck and mouth forming portion 201, a cylindrical sidewall portion 202 and a lower base-forming portion 203, all extending around the longitudinal axis 200*a* of the container (FIG. 13). The upper portion 201 includes a neck-forming transition 204 leading to a container mouth 205. The transition portion 204 of the container may take any conveniently usable and moldable shape, such as frustoconical, hemispherical, ogive or other shape as may be selected by the container designer. The finish 206 of the container adjacent the container mouth 205 may take any usable form that may accommodate means for closing the container as will be apparent to those skilled in the art.

As with the containers illustrated and described above, the invention resides in the lower base-forming portion 203 of the container. The hollow foot-forming portions 221 of the container 200 are preferably substantially like the hollow foot-forming portions described above for the container of FIGS. 8–11. As shown in FIGS. 13 and 15A, the downwardly convex sections 226 of the container of FIGS. 12–14 have cross-sections in their central portions which are preferably hyperbolic and which flare outwardly over 200 percent in merging substantially tangentially into the cylindrical sidewall portion 202 at their upper ends and which form the central portion 220 of the base-forming portion 203 between the plurality of hollow foot-forming portions 221. Because downwardly convex sections 226 have a hyperbolic cross-section, the bottom portion 203 of the container can comprise a minimal portion of the container height, can provide a maximal container volume for a given container height, can provide a maximal cylindrical sidewall height for labelling, can provide a lower container center of gravity and improved container stability and reduced stress concentrations, crazing and stress cracking.

EXAMPLE II

Such a carbonated beverage bottle 200 of the invention for containing two liters can have an overall height of about 11.8 inches, for filling within about 1.2 inches of the mouth 205. Any finish 206 can be used with containers of the invention; one preferable finish for a carbonated beverage can comprise a threaded opening with a PCO-28 finish. The right cylindrical sidewall 202 can have a diameter on the order of about 4.28 inches, and a neck-forming transition 204 between the cylindrical sidewall 202 and the bottle container mouth 205 can be, as shown, an ogive-like shape extending downwardly from an inch or so below the mouth 205 to blend into the cylindrical sidewall 202 approximately 4 inches below the mouth 202. As illustrated in FIGS. 13 and 15A, the lower base-forming portion 203 of such a bottle can extend from the plane 25 of the supporting feet 222 upwardly a distance 203*a* of about 2 inches to the place where the hollow feet forming portions 221 and downwardly convex hyperbolic segments 226 merge into the cylindrical sidewall 202. The downwardly convex hyperbolic segments 226 can also flare outwardly (i.e., expand circumferentially) about 200 percent between the central bottom portion 220 and their merger with the cylindrical sidewall portion 202. The outer surfaces 235 of the hollow foot-forming portions 221 have radii of curvature of about 5.75 inches which are located so the outer surfaces 235 merge tangentially into the cylindrical sidewall portions and merge tangentially into the radii 228 (FIG. 15). The hyperbolic cross-section formed by the downwardly convex section 226 is generally asymptotic with the cross-section of the circular sidewall section 202 at its top and is tangent at its bottom with a plane parallel with, and located a distance 224 of and about 0.30 inches above, the plane 25 of the container feet 222 and can have a coefficient of curvature of about 0.75.

The hollow foot-forming portions 221 can include clearance-forming portions 223 extending from the central portion 220 of the container bottom to their feet area 222. The clearance-forming portions are, preferably, formed by opposing radii 230, 231 of about 0.900 inches, and the container feet 222 thus formed provide a contact diameter of 222*a* of about 2.95 inches. The sections of the foot-forming portions 221 between the feet 222 and their outer surfaces 235 are preferably formed with an internal radii of curvature 228 of about 0.42 inch, with their centers located on a circle with a diameter equal to the foot contact diameter 222*a* and positioned to provide tangency with the plane 25 of the feet 222. The solid angle 229 is preferably 40 degrees As illustrated above, the preferred container bottoms of the invention include downwardly convex segments between their hollow foot-forming portions that are smoothly curved, such as the segments with circular cross-sections of the containers of FIGS. 1–11 and the segments with hyperbolic cross-sections of the container of FIGS. 12–14. The downwardly curved segments may have other smoothly curved cross-sections, such as illustrated by the elliptical cross-section 326 shown in FIG. 15B and the compound curved cross-section 426 shown in FIG. 15C. Such smooth curves can be developed from high order polynomial equations and developed with CAD/CAM systems such as "EUCLID" by Matra Data Vision, 2 Highland Drive, Tewksbury, Mass. 01876.

The invention can thus provide plastic containers for carbonated beverages with low cost and weight manufacturable from plastic material by blow molding with minimal plastic material in their walls, with maximal volumes with minimal heights in easily handled diameters, with maximal height cylindrical sidewall portions, with excellent stability in both filled and unfilled conditions because of their wide foot spans and their resistance to distention of their bottom portions and with durability because of their relative freedom from excessively high stress concentrations, crazing and stress cracking.

While a presently known preferred embodiment of the invention has been described above, those skilled in the art will recognize that other embodiments of the invention may be devised within the scope of the following claims.

We claim:

1. A blow molded plastic container for carbonated beverages, comprising an upper mouth-forming portion, a cylindrical sidewall portion and a lower base-forming portion, all about a central longitudinal axis, said lower base-forming portion comprising a plurality of hollow foot-forming portions extending outwardly from the central portion of the lower base-forming portion to form a plurality of feet lying substantially on a contact diameter, each foot-forming portion including between said central portion of the base-forming portion and its foot, a bottom clearance-forming portion including a compound-curved offset of a substantial fraction of an inch formed by opposing radii of curvature, said compound-curved offset curving downwardly from said central portion about a radius of curvature below the bottom of the base-forming portion before curving about a radius of curvature above the bottom of the base-forming portion, and further comprising a plurality of downwardly convex segments between adjacent pairs of hollow foot-forming portions, each of said downwardly convex segments extending upwardly between said adjacent hollow foot-forming portions, the downwardly convex segments having cross-sections, in a radially extending plane in its central portion coplanar with the longitudinal axis of the container, with a coefficient of curvature of from about 0.68 to about 0.75, and flaring outwardly to merge into said cylindrical sidewall portion at its upper end.

2. The plastic container of claim 1 wherein said central portion is downwardly convex.

3. The plastic container of claim 2 wherein each foot-forming portion increases circumferentially in size as it extends radially.

4. The plastic container of claim 1 wherein all internal radii of the hollow foot-forming portions are a substantial fraction of an inch.

5. The plastic container of claim 1 wherein the opposing radii are equal.

6. The plastic container of claim 1 wherein each of the hollow foot-forming portions merges into the adjoining downwardly convex segments with straps having curvatures of a substantial fraction of an inch.

7. The plastic container of claim 1 wherein the opposing radii of curvature of said bottom clearance forming portions lie in a range of about 15 percent to over about 30 percent of the contact diameter.

8. The plastic container of claim 1 wherein the opposing radii of curvature of said bottom clearance forming portion, lie in a range of less than about 10 percent to over about 20 percent of the outside diameter of the container.

9. The container of claim 1 wherein the diameter of the cylindrical sidewall is more than about 3.27 inches.

10. A plastic container comprising a cylindrical sidewall, an upper mouth-forming portion and a lower bottom-forming portion, all about a central longitudinal axis, said bottom-forming portion comprising a plurality of downwardly convex, hollow foot-forming portions extending radially and downwardly from a plurality of intervening downwardly convex segments and forming a plurality of feet supporting the container on a contact diameter, each of said foot-forming portions comprising a bottom clearance-forming portion between its supporting foot and the central longitudinal axis, each bottom clearance-forming portion including a compound-curved offset of a substantial fraction of an inch formed by opposing radii of curvature lying in a range of about 15 percent to over about 30 percent of the contact diameter, each said compound-curved offset curving downwardly about a center of curvature below the bottom-forming portion before curving about a center of curvature above the bottom-forming portion, each of said downwardly convex segments expanding outwardly and upwardly between adjacent foot-forming portions in merging with said cylindrical sidewall, the downwardly convex segments having cross-sections, in a radially extending plane in its central portion coplanar with the longitudinal axis of the container, with a coefficient of curvature of from about 0.68 to about 0.75.

11. The container of claim 10 wherein the diameter of the cylindrical sidewall is more than about 3.27 inches and the smoothly curved cross-section is generally elliptical.

12. A blow molded plastic container for carbonated beverages, comprising an upper mouth-forming portion, a cylindrical sidewall and a lower base-forming portion, all about a central longitudinal axis, including a plurality of circumferentially-spaced, downwardly convex segments and a plurality of intervening and circumferentially-spaced, convex, hollow foot-forming portions expanding radially outwardly from the longitudinal axis of the container to expansive outer surfaces merging with the sidewall and downwardly from the circumferentially-spaced, downwardly convex segments, each said foot-forming portion providing a bottom clearance-forming portion, and each downwardly convex segment having a cross-section, in a radially extending plane in its central portion coplanar with the longitudinal axis of the container, with a coefficient of curvature of from about 0.68 to about 0.75 and expanding outwardly and upwardly by more than 200 percent in merging with the sidewall.

13. The container of claim 12 wherein the diameter of the cylindrical sidewall is more than about 3.27 inches.

14. The plastic container of claim 12 where each bottom clearance-forming portion includes a compound-curved offset formed between the longitudinal axis and the container sidewall by opposing radii of curvature in a range of about 15 percent to over about 30 percent of a diameter about the longitudinal axis at which the foot-forming portions contact a supporting surface, said compound-curved offset first curving downwardly about a center of curvature below the bottom-forming portion before curving about a center of curvature above the bottom-forming portion.

15. The plastic container of claim 12 wherein each downwardly convex segment expands outwardly and upwardly by at least about 400 percent in merging with the sidewall.

16. The plastic container of claim 12 wherein the lower base-forming portion comprises a central downwardly convex central portion between the plurality of foot-forming portions.

17. A plastic container comprising a generally cylindrical sidewall portion, an upper mouth-forming and bottom portion, all about central longitudinal axis, said bottom portion including a plurality of spaced totally convex, hollow foot-forming portions extending radially and downwardly from a central bottom portion to form supporting feet adjacent the periphery of the container and a plurality of compound-curved bottom clearance forming portions, said bottom portion further including a plurality of spaced, downwardly convex segments between said plurality of hollow foot-forming portions, said downwardly convex segments having cross-sections in a radially extending plane in its central portion coplanar with the longitudinal axis of the container, with a coefficient of curvature of from about 0.68 to about 0.75 and flaring outwardly and upwardly in merging with the generally cylindrical sidewall portion.

18. The plastic container of claim 17 wherein said foot-forming portions have, in their central planes coplanar with the longitudinal axis, compound-curved cross-sections defined by two opposing radii.

19. The plastic container of claim 18 wherein the two opposing radii lie in a range of about 15 percent to over about 30 percent of the diameter about the longitudinal axis at which the foot-forming portions contact a supporting surface.

20. The plastic container of claim 18 wherein the two opposing radii lie in a range of about 10 percent to about 20 percent of the diameter of the cylindrical side wall portion of the container.

21. The plastic container of claim 19 wherein the two opposing radii lie in a range of about 30 percent to about 36 percent of the contact diameter.

22. The plastic container of claim 17 wherein the downwardly convex segments flare outwardly and upwardly to more than twice their extents in merging with the generally cylindrical sidewall portion.

23. The plastic container of claim 18 wherein the downwardly convex segments flare outwardly and upwardly to more than four times their extents in merging with the generally cylindrical sidewall, and the two opposing radii lie in a range of about 15 percent to over about 30 percent of a diameter about the longitudinal axis at which the foot-forming portions contact a supporting surface.

24. The plastic container of claim 23 wherein the two-opposing radii lie in a range of about 30 percent about 36 percent of the contact diameter.

25. The container of claim 17 wherein the diameter of the cylindrical sidewall is more than about 3.27 inches.

26. A blow molded plastic container for a carbonated beverage comprising an upper mouth-forming portion, a cylindrical sidewall portion, and a lower base-forming portion, all about a central longitudinal axis, said lower base-forming portion comprising a plurality of hollow foot-forming portions extending outwardly and downwardly from a central base portion and further comprising a plurality of smoothly curved downwardly convex segments extending upwardly from the central base portion between adjacent hollow foot-forming portions, the downwardly convex segments having cross-sections, in a radially extending plane in its central portion coplanar with the longitudinal axis of the container, with a coefficient of curvature of from about 0.68 to about 0.75 and flaring outwardly at their upper ends and merging into the cylindrical sidewall portion.

27. The container of claim 26 wherein the diameter of the cylindrical sidewall is more than about 3.27 inches.

* * * * *